US005881580A

United States Patent [19]

Ra

[11] Patent Number: 5,881,580

[45] Date of Patent: Mar. 16, 1999

[54] AUXILIARY WASHING DEVICE IN A WASHING MACHINE

[75] Inventor: Jun-Ho Ra, Seoul, Rep. of Korea

[73] Assignee: Daewoo Electronics Co., Ltd., Seoul, Rep. of Korea

[21] Appl. No.: 978,425

[22] Filed: Nov. 25, 1997

[30] Foreign Application Priority Data

Nov. 30, 1996 [KR] Rep. of Korea ..... 1996-60451

[51] Int. Cl.[6] ..... D06F 17/10

[52] U.S. Cl. ..... 68/132; 68/131; 68/134

[58] Field of Search ..... 68/131, 132, 134, 68/113, 117, 122, 123, 125, 129

[56] References Cited

U.S. PATENT DOCUMENTS

| | | | |
|---|---|---|---|
| 43,290 | 6/1864 | Clark | 68/122 |
| 361,919 | 4/1887 | Bickel | 68/122 X |
| 1,629,218 | 5/1927 | Larson et al. | 68/113 X |
| 4,279,135 | 7/1981 | Cox | 68/134 X |
| 4,893,486 | 1/1990 | Diaz | 68/134 X |

FOREIGN PATENT DOCUMENTS

| | | | |
|---|---|---|---|
| 137902 | 7/1950 | Australia | 68/132 |
| 182575 | 2/1936 | Sweden | 68/117 |
| 0381516 | 10/1932 | United Kingdom . | |
| 2187479 | 9/1987 | United Kingdom . | |
| 2310673 | 9/1997 | United Kingdom . | |

*Primary Examiner*—Philip R. Coe

*Attorney, Agent, or Firm*—Beveridge, DeGrandi, Weilacher & Young LLP

[57] ABSTRACT

Auxiliary washing device in a washing machine comprises a beam mounted on an upper side of an outer tub and extended to an inner space of a washing tub, and a washing bar supported at an extended end of the beam to be capable of swinging. The washing bar is swung upwardly by a motor and downwardly by a torsion spring. When electric power to the motor is stopped at the position in which the washing bar is swung upwardly by the motor, the washing bar swings downwardly by the torsion of the torsion bar to strike laundry in the washing tub. Thus, washing is enhanced by the impact to the laundry, and the laundry is stirred upwardly and downwardly. Therefore, inefficiency in the upper part of the washing tub due to the washing operation only by pulsator is prevented, and washing of all clothes is enhanced.

8 Claims, 5 Drawing Sheets

AUXILIARY WASHING DEVICE IN A WASHING MACHINE

BACKGROUND OF THE INVENTION

1. Field of the Invention

The present invention relates to an auxiliary washing device in a washing machine, and more particularly to an auxiliary washing device having a washing bar for striking laundry accommodated in a washing tub.

2. Prior Art

Generally, a washing machine which accommodates laundry and performs washing and dehydrating operations has, as shown in FIG. 1, an outer tub 110 installed in a casing 100, a washing tub 120 installed in the outer tub 110 for accommodating laundry and water, a pulsator 130 mounted on a bottom of the washing tub 120 for rotating the washing water in the washing tub 120, a driving motor 130 disposed under the outer tub 110 for driving the pulsator 130, and a gear assembly 150 for transmitting the power of the driving motor 140 selectively to the pulsator 130 and the washing tub 120. In the washing operation, the power of the driving motor 140 is transmitted to the pulsator 130 through the gear assembly 150 in order to rotate the pulsator 130, by which vortical air flow is generated in the washing tub 120. The pulsator 130 may possibly be rotated in bilateral directions according to the operation of the driving motor 140. The washing operation of the laundry accommodated in the washing tub 120 is performed by the vortical water flow generated by the pulsator 130.

In the dehydrating operation, the power of the driving motor 140 is transmitted to both the washing tub 120 and the pulsator 130, so the washing tub 120 is rotated together with the pulsator 130 at a high speed. The dehydrating operation is performed by centrifugal force generated in that situation.

In such a conventional washing machine, strong water flow is generated in the lower area of the washing tub 120, but water flow is weak in the upper area of the washing tub 120 since the pulsator 130 is rotated in the lower part of the washing tub 120. Thus, if the amount of the laundry is great, the washing operation is efficiently performed in the lower part of the washing tub 120, but is not efficiently performed in the upper part of the washing tub 120. Moreover, according to the tendency that the size of a washing machine has become larger, the washing tub 120 of great capacity is adopted, so the laundry is not efficiently washed by the pulsator 130 installed in the bottom of the washing tub 120.

SUMMARY OF THE INVENTION

The present invention has been proposed to overcome the above described problems in the prior art, and accordingly it is an object of the present invention to provide an auxiliary washing device of the washing machine which washes the laundry efficiently despite the great amount of the laundry.

Another object of the present invention is to provide an auxiliary washing device of the washing machine which can enhance the washing effect by moving the laundry in the washing tub upward and downward.

Still another object of the present invention is to provide an auxiliary washing device of the washing machine which can enhance the washing effect by striking the laundry in the upper part of the washing tub.

To achieve the above objects, the present invention provides an auxiliary washing device in a washing machine comprising: a beam mounted on an upper side of an outer tub installed in a casing of said washing machine, said beam being extended to an inner space of a washing tub installed in said outer tub; a washing bar supported at an extended end of said beam to be capable of swinging; and a means for swinging said washing bar to strike laundry accommodated in said washing tub.

Said swinging means comprises: a motor; a wire driven by said motor, said wire for pulling said washing bar so that said washing bar swings along a swinging direction thereof; and a swinging spring for applying an elastic force to said washing bar along a direction resisting the swinging of said washing bar by said wire.

Furthermore, it is preferable to further comprise a means for moving said washing bar along a vertical direction, in which said moving means comprises: a fixed cylinder mounted at an end of said beam; a moving cylinder being slidably assembled by insertion with said fixed cylinder, said moving cylinder being installed with said washing bar; a coil spring for pushing said moving cylinder downwardly and relatively to said fixed cylinder; and a means for hooking said moving cylinder so that said moving cylinder is moved toward a direction resisting an elastic force of said coil spring when said motor pulls said wire.

Also, the auxiliary washing device in the present invention comprises a means for rotating said moving cylinder relatively to said fixed cylinder. Said rotating means comprises: a groove formed at an outer periphery of said fixed cylinder, said groove going around the outer periphery of said fixed cylinder, said groove consisting of a plurality of vertical groove parts and a plurality of tilted groove parts connecting the vertical groove parts; and a protrusion protruding at an inner periphery of said moving cylinder, said protrusion being accommodated in the groove. Said protrusion is guided alternately by the vertical groove parts and the tilted groove parts when said moving cylinder moves upward and downward, whereby said moving cylinder is rotated. The laundry in the washing tub is equally struck by such a rotating means.

Said washing bar is formed with a plurality of projections at the outer surface thereof, and the striking efficiency of the laundry is enhanced by the projections.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
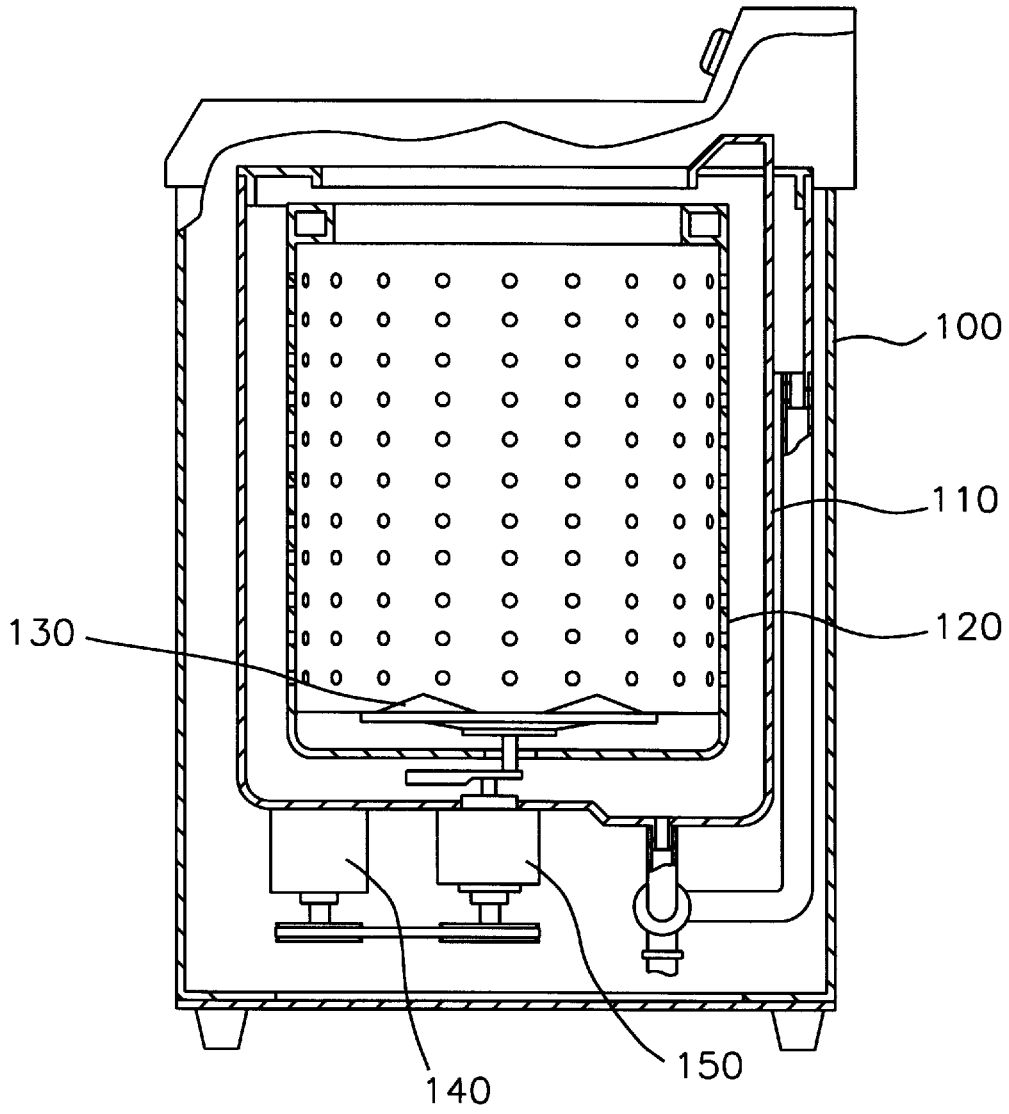
FIG. 1 PRIOR ART
FIG. 1 is a side sectional view of a conventional washing machine.

Hereinafter, the present invention will be described in detail with reference to the drawings. The same parts with the parts in the conventional washing machine are referenced with the same reference numerals.

Figure 2:
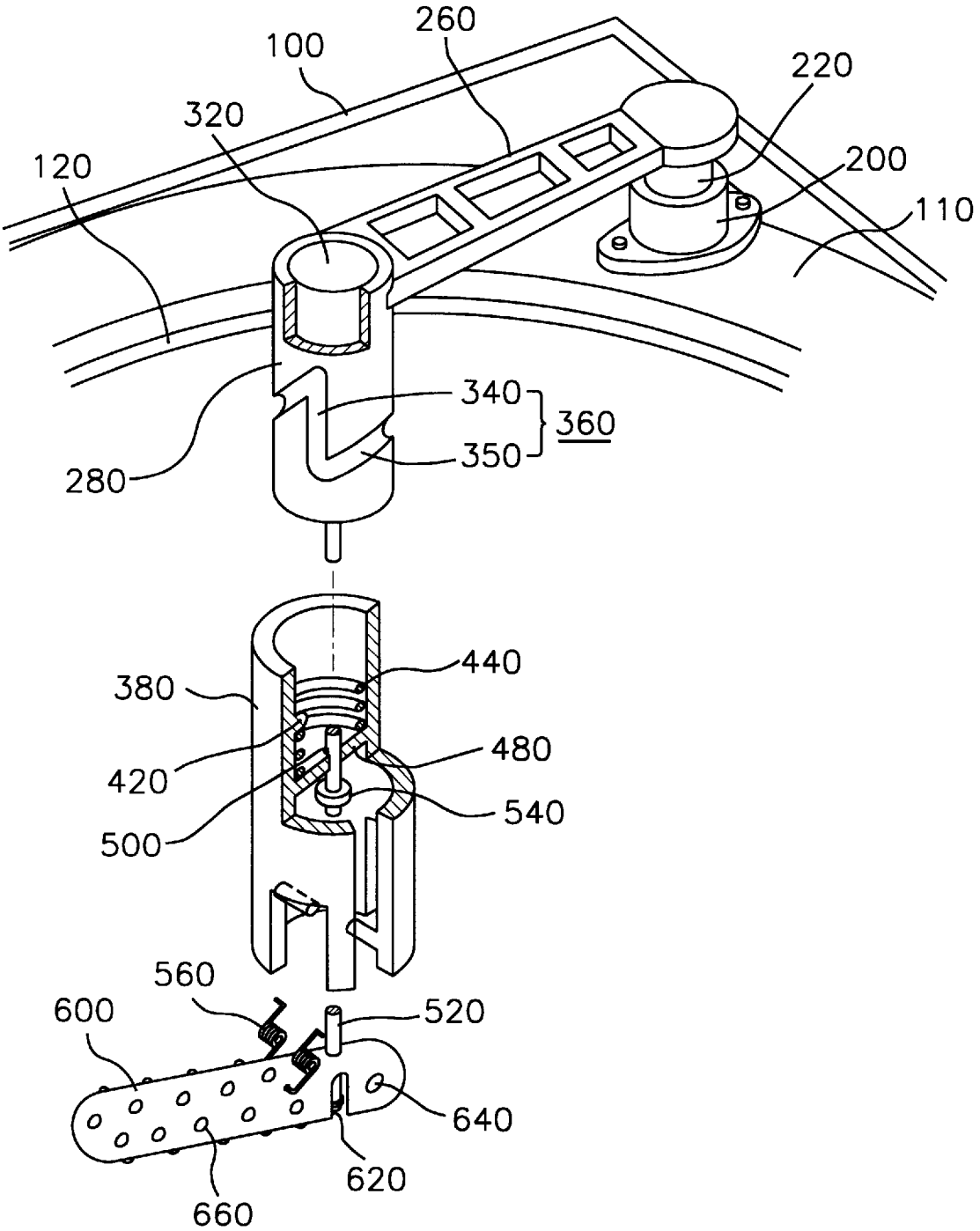
FIG. 2 is an exploded perspective view of an auxiliary washing device according to the present invention.
Figure 3:
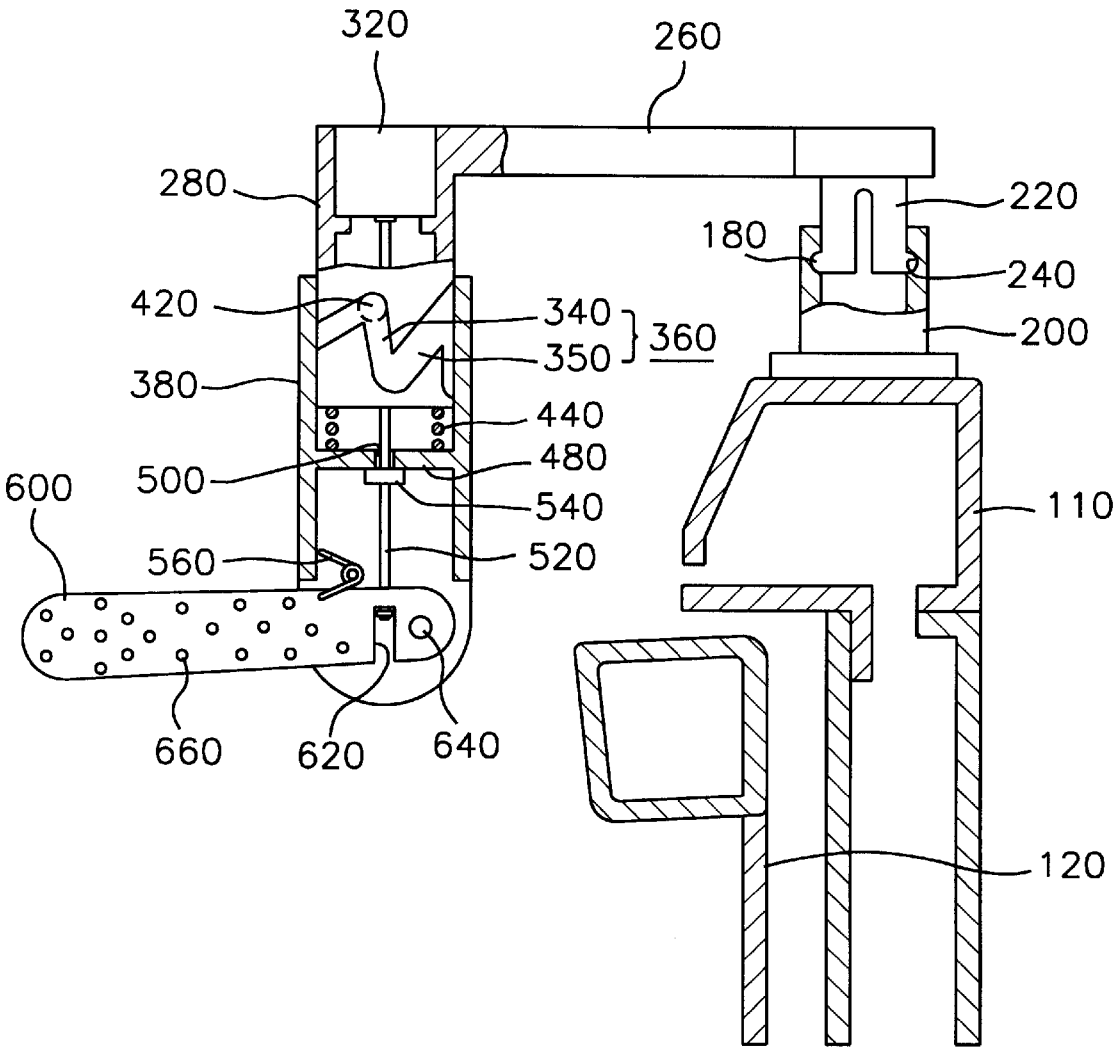
FIG. 3 through FIG. 5 are side sectional views showing the operating states of the auxiliary washing device in FIG. 2.
Figure 4:
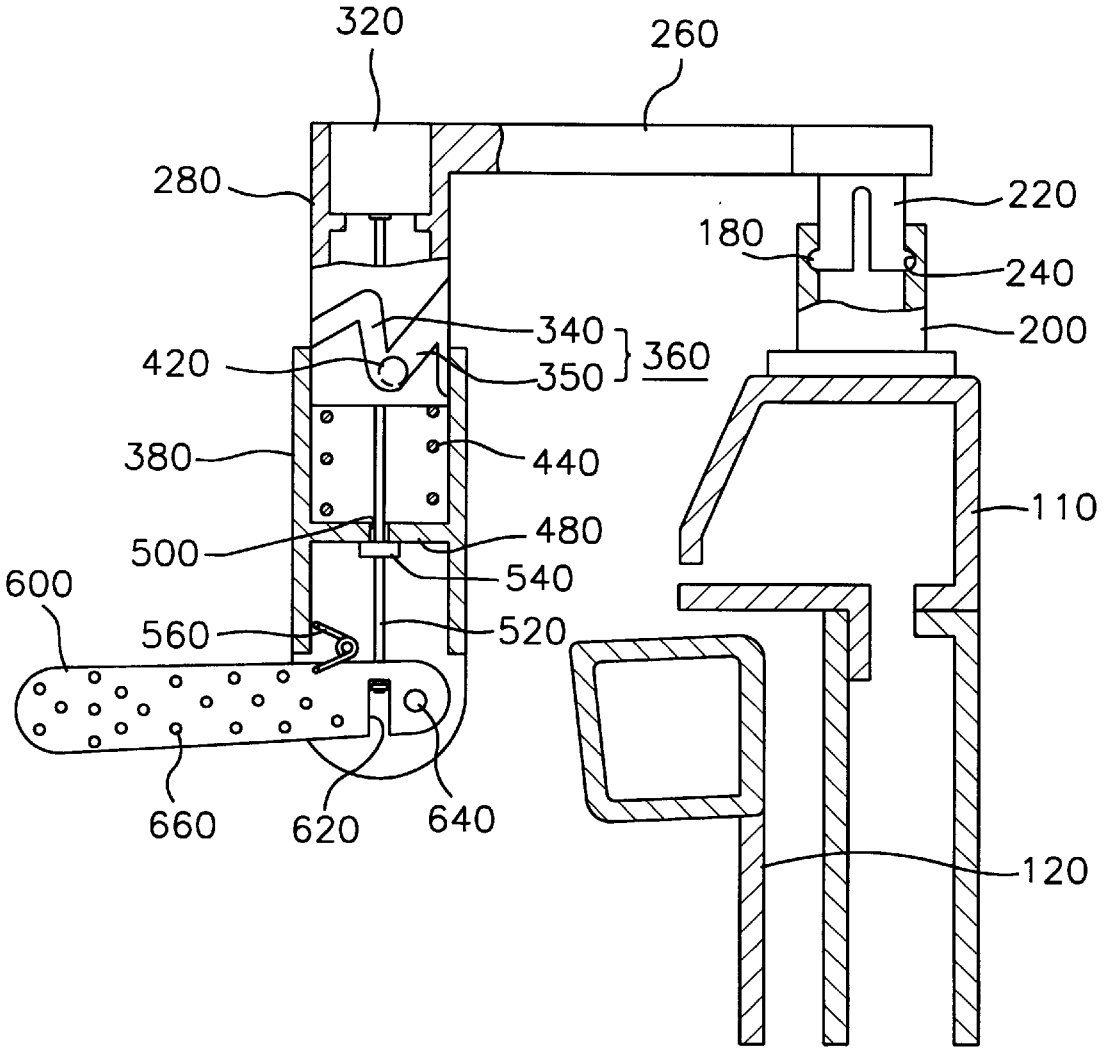
Figure 5:
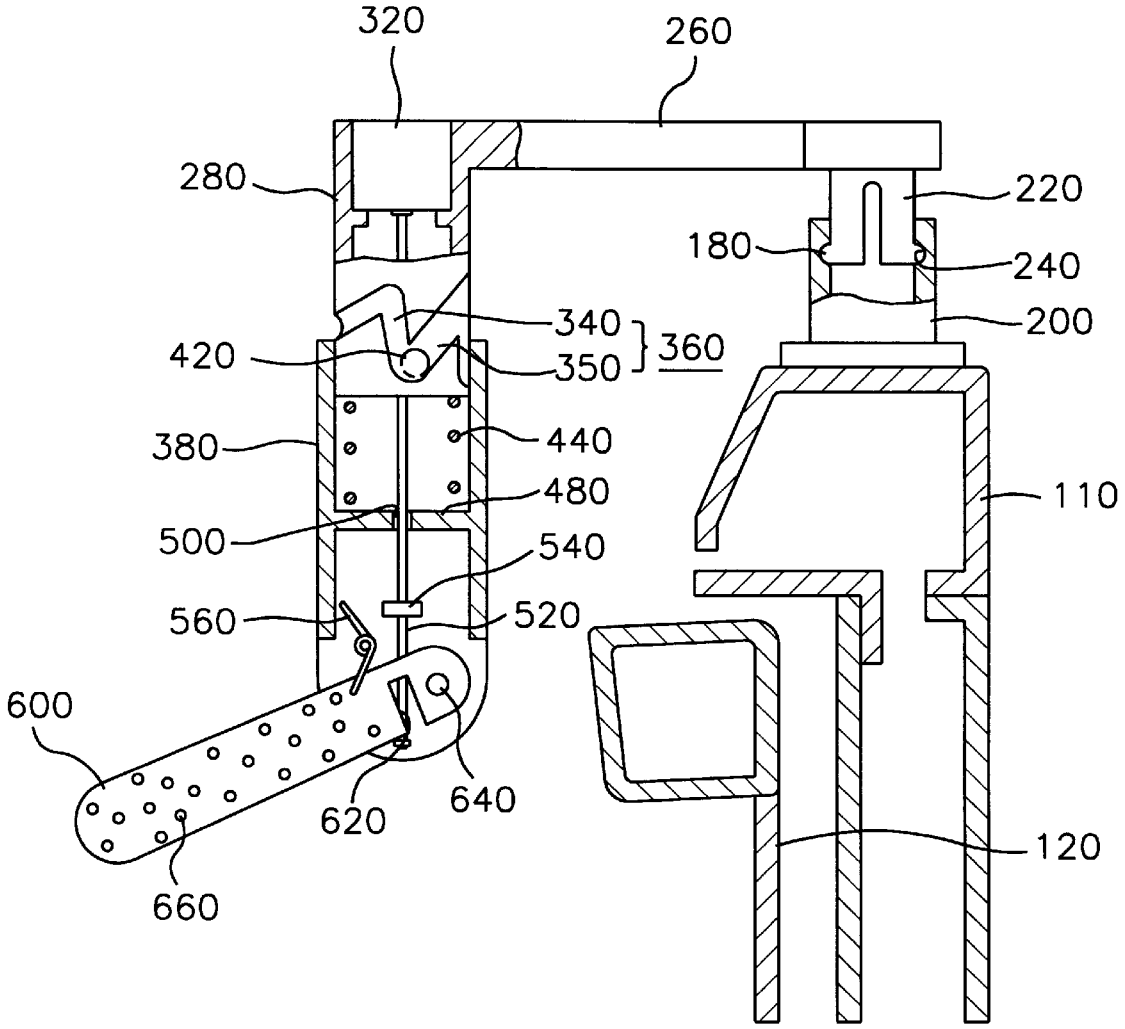

FIG. 2 is an exploded perspective view of an auxiliary washing device according to the present invention, and FIG. 3 through FIG. 5 are side sectional views showing the operating states of the auxiliary washing device in FIG. 2. The auxiliary washing device comprises a fixing member 200 mounted on the upper side of the outer tub 110 installed in the casing 100 of the washing machine, a beam 260 fixed by the fixing member 200, a fixed cylinder 280 and a moving cylinder 380 installed at an end of the beam 260, and a washing bar 600 installed at the lower end of the moving cylinder 380.

One end of the beam 260 is fixed and supported by the fixing member 200. The fixing member 200 has the shape of a hollow cylinder, and a recess 240 for fixing the beam 260 is formed at the inner periphery thereof. At said one end of the beam 260, a shaft 220 which is assembled with the inner periphery of the fixing member 200 by form-fitting is installed. A protrusion 180 assembled with the recess 240 of the fixing member 200 is formed at the lower periphery of the shaft 220. The protrusion 180 is inserted into the recess 240, whereby the beam 260 is steadfastly fixed. The beam 260 is extended to the upper inner space of the washing tub 120.

The fixed cylinder 280 is fixed at the other end of the beam 260, and a moving cylinder 380 is assembled with the fixed cylinder 280. The fixed cylinder 280 is inserted at the inner periphery of the moving cylinder 380 to be slidably assembled therewith. Inside the moving cylinder 380, a horizontal wall 480 is formed which partitions the inner space of the moving cylinder 380 into an upper space and a lower space. A coil spring 440 is installed at the upper space of the moving cylinder 380. The coil spring 440 is disposed between the horizontal wall 480 and the lower end of the fixed cylinder 280, whereby the moving cylinder 380 is pushed downward relatively to the fixed cylinder 280. A hole 500 is formed at the central area of the horizontal wall 480.

A washing bar 600 is installed at the lower end of the moving cylinder 380. One end of the washing bar 600 is fixed at the moving cylinder 380 by a pin 640, whereby the washing bar 600 is fixed at the moving cylinder 380 to be capable of swinging. The washing bar 600 is installed with a torsion spring 560. One end of the torsion spring 560 is fixed at an outer part of the washing bar 600, and the other end of the torsion spring 560 is fixed at a part of the moving cylinder 380. The torsion spring 560 applies torsion to the washing bar 600 so that the washing bar 600 swings downwardly. The washing bar 600 is formed with a plurality of projections 660 at the outer surface thereof.

A motor 320 is accommodated at an upper inner space of the fixed cylinder 280, and a wire 520 driven by the motor 320 is connected to the motor 320. The wire 520 is extended downward through the inner space of the fixed cylinder 280, inner space of the moving cylinder 380, and the hole 500. At the lower side of the washing bar 600 which is adjacent to the pin 640, a recess 620 for supporting the washing bar 600 is formed, and the lower end of the wire 520 is accommodated in the recess 620. Thus, the washing bar 600 is supported by the wire 520. When the motor 320 is operated to pull the wire 520, the washing bar 600 receives a force resisting the torsion of the torsion spring 560, whereby the washing bar 600 swings upwardly to be disposed horizontally. When the operation of the motor 320 is stopped, the pulling force of the wire 520 is released, whereby the washing bar 600 swings downwardly by its own weight and the torsion of the torsion spring 560.

At an area of the wire 520, a hooking member 540 is installed. The hooking member 540 is formed to be in the shape of a disc having a larger radius than the radius of the hole 500. Thus, the hooking member 540 hooks the horizontal wall 480 when the wire is pulled by the motor 320, whereby the moving cylinder 380 which has been pushed downward by the coil spring 440 is moved upward. Also, when the pulling force of the wire 520 is released, the moving cylinder 380 is moved downward again by the elastic force of the coil spring 440.

A groove 360 is formed at the outer periphery of the fixed cylinder 280. The groove 360 goes around the outer periphery of the fixed cylinder 280. The groove 360 consists of a plurality of vertical groove parts 340 and a plurality of tilted groove parts 350. Each tilted groove part 350 connects two vertical groove parts 340 which are adjacent to each other. At the inner periphery of the moving cylinder 380, a protrusion 420 accommodated in the groove 360 of the fixed cylinder 280 is formed. The protrusion 420 is accommodated at the upper end part of the vertical groove part 340 when the moving cylinder 380 is moved upward, and the protrusion 420 is accommodated at the lower end part of the vertical groove part 340 when the moving cylinder 380 is moved downward. When the moving cylinder 380 is moved upward again, the protrusion 420 is guided by the tilted groove part 350, and then it will be accommodated at the upper end part of other vertical groove part which is beside the previous vertical groove part. When the moving cylinder 380 is moved downward again, the protrusion 420 is guided to the lower part of said other vertical groove part. Thus, when the moving cylinder 380 is reciprocated along the upward and downward directions, the protrusion 420 is alternately guided by the vertical groove part 340 and the tilted groove part 350, whereby the moving cylinder 380 is rotated.

Hereinbelow, the operation and the effect of the auxiliary washing device according to the present invention will be described.

When the operation of the washing machine begins, the pulsator 130 installed at the lower part of the washing tub 120 begins to rotate. During the rotation of the pulsator 130, the motor 320 is supplied with electric power, then the wire 520 is pulled, whereby the auxiliary washing device is maintained to the state shown in FIG. 3. That is, since the wire 520 is pulled by the motor 320, the hooking member 540 hooks the horizontal wall 480 to move the moving cylinder 380 upward, and the washing bar 600 is swung by the wire 520 against the elastic force of the torsion spring 560, to be maintained in a horizontal position. In that situation, the protrusion 420 is located at the upper end part of the vertical groove part 340.

The operation of the pulsator 130 stops after performing the washing operation by several turns thereof. When the operation of the pulsator 130 stops, the auxiliary washing device begins to operate. Supply of the electric power to the motor 320 is stopped, whereby the pulling force of the wire 520 is released. Then, as shown in FIG. 4, the moving cylinder 380 is moved downward by the elastic force of the coil spring 440. The protrusion 420 is guided by the vertical groove part 340 to be moved down toward the lower end part of the vertical groove part 340, whereby the moving cylinder 380 is moved downward until the protrusion 420 reaches the lower end part of the vertical groove part 340.

As the released state of the pulling force of the wire 520 continues, the washing bar 600 swings downward, then the auxiliary washing device is positioned as shown in FIG. 5. By such a process, the washing bar 600 strikes the laundry accommodated at the upper part of the washing tub 120. Therefore, the impact is applied to the laundry to perform the washing operation, and the laundry floating at the upper part of the washing tub 120 moves down, whereby the laundry is stirred upward and downward in the washing tub

120. The projections 660 formed at the washing bar 600 increase the frictional force between the laundry and the washing bar 600, and they also increase the impact to the laundry, when the laundry is struck.

When the motor 320 is supplied with the electric power again, the wire 520 is pulled, and then the washing bar 600 swings against the elastic force of the torsion spring 560 as shown in FIG. 4. As the pulling of the wire 520 continues, the moving cylinder 380 is moved upward by the hooking member 540 which hooks the horizontal wall 480. During that situation, the protrusion 420 is guided by the tilted groove part 350 to be moved toward other vertical groove part 340, whereby the moving cylinder 380 is rotated while being moved upward. The washing bar 600 is rotated as much as the rotated angle of the moving cylinder 380. When the supply of electric power to the motor 320 is stopped again, the washing bar 600 strikes the laundry according to the aforementioned process. In that situation, the striking position of the washing bar 600 is a position rotated as much as the rotated angle of the moving cylinder 380. Therefore, the laundry in the washing tub 120 is equally struck, and the washing effect and the stirring effect by the striking operation become even greater.

After the striking operation of the washing bar 600 is repeated several times, the washing operation by the pulsator 130 is performed again. After the washing operation by the pulsator 130 is performed several times, the washing operation by the auxiliary washing device is performed again.

In the present embodiment, the example that the washing operations by the pulsator 130 and the auxiliary washing device are performed in turn is shown, but it is possible to control the washing machine so that both washing operations are performed simultaneously.

As described above, according to the present invention, the washing effect is enhanced by striking and thereby stirring the upper part of the laundry, and in particular, efficient washing can be achieved in the washing machine of great washing capacity.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. An auxiliary washing device in a washing machine comprising:

a beam mounted on an upper side of an outer tub installed in a casing of said washing machine, said beam being extended to an inner space of a washing tub installed in said outer tub;

a washing bar supported at an extended end of said beam to be capable of swinging; and a means for swinging said washing bar to strike laundry accommodated in said washing tub.

2. The auxiliary washing device in a washing machine as claimed in claim 1, wherein said swinging means comprises:

a motor;

a wire driven by said motor, said wire for pulling said washing bar so that said washing bar swings along a swinging direction thereof; and a swinging spring for applying an elastic force to said washing bar along a direction resisting the swinging of said washing bar by said wire.

3. The auxiliary washing device in a washing machine as claimed in claim 2, further comprising a means for moving said washing bar along a vertical direction.

4. The auxiliary washing device in a washing machine as claimed in claim 3, wherein said moving means comprises:

a fixed cylinder mounted at an end of said beam;

a moving cylinder being slidably assembled by insertion with said fixed cylinder, said moving cylinder being installed with said washing bar;

a coil spring for pushing said moving cylinder downwardly and relatively to said fixed cylinder; and a means for hooking said moving cylinder so that said moving cylinder is moved toward a direction resisting an elastic force of said coil spring when said motor pulls said wire.

5. The auxiliary washing device in a washing machine as claimed in claim 4, wherein said hooking means comprises:

a horizontal wall formed at an inner side of said moving cylinder, said horizontal wall being formed with a hole at a central part thereof through which said wire passes; and a hooking member mounted at a part of said wire, said hooking member for hooking said horizontal wall when said motor pulls said wire.

6. The auxiliary washing device in a washing machine as claimed in claim 4, further comprising a means for rotating said moving cylinder relatively to said fixed cylinder.

7. The auxiliary washing device in a washing machine as claimed in claim 6, wherein said rotating means comprises:

a groove formed at an outer periphery of said fixed cylinder, said groove going around the outer periphery of said fixed cylinder, said groove consisting of a plurality of vertical groove parts and a plurality of tilted groove parts connecting the vertical groove parts; and a protrusion protruding at an inner periphery of said moving cylinder, said protrusion being accommodated in the groove, wherein said protrusion being guided alternately by the vertical groove parts and the tilted groove parts when said moving cylinder moves upward and downward, whereby said moving cylinder is rotated.

8. The auxiliary washing device in a washing machine as claimed in claim 1, wherein said washing bar is formed with a plurality of projections at the outer surface thereof.

* * * * *